US011462165B2

(12) United States Patent
Dong

(10) Patent No.: US 11,462,165 B2
(45) Date of Patent: Oct. 4, 2022

(54) PIXEL DRIVING CIRCUIT, RELATED DRIVING METHOD, PIXEL CIRCUIT, AND DISPLAY PANEL

(71) Applicant: BOE TECHNOLOGY GROUP CO., LTD., Beijing (CN)

(72) Inventor: Tian Dong, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 136 days.

(21) Appl. No.: 16/767,456

(22) PCT Filed: Jul. 2, 2019

(86) PCT No.: PCT/CN2019/094392

§ 371 (c)(1),
(2) Date: May 27, 2020

(87) PCT Pub. No.: WO2021/000259

PCT Pub. Date: Jan. 7, 2021

(65) Prior Publication Data

US 2021/0407417 A1 Dec. 30, 2021

(51) Int. Cl.

| | |
|---|---|
| ***G09G 3/3258*** | (2016.01) |
| ***G09G 3/20*** | (2006.01) |
| ***G09G 3/3291*** | (2016.01) |

(52) U.S. Cl.

CPC ..... *G09G 3/3258* (2013.01); *G09G 3/2092* (2013.01); *G09G 3/3291* (2013.01); *G09G 2310/061* (2013.01); *G09G 2320/043* (2013.01)

(58) Field of Classification Search

CPC ..... G09G 3/3258; G09G 3/2092; G09G 2310/061; G09G 2320/043; G09G 3/30–3291

See application file for complete search history.

(56) References Cited

U.S. PATENT DOCUMENTS

| | | | | |
|---|---|---|---|---|
| 2016/0225313 | A1* | 8/2016 | Qing | G09G 3/2007 |
| 2017/0039954 | A1* | 2/2017 | Sun | G09G 3/3233 |
| 2017/0061868 | A1* | 3/2017 | Tseng | G09G 3/3233 |
| 2019/0385503 | A1* | 12/2019 | Lin | G09G 3/20 |

* cited by examiner

*Primary Examiner* — Roberto W Flores
(74) *Attorney, Agent, or Firm* — Dave Law Group LLC; Raj S. Dave

(57) ABSTRACT

A pixel driving circuit is disclosed which includes an input circuit, a reset circuit, a driving transistor and a compensation circuit. The input circuit is configured to provide a data voltage from an input signal terminal to a first node according to a gate driving signal from a gate driving signal terminal. The reset circuit is configured to provide a first voltage from a first voltage terminal to a second node according to a reset control signal from a reset control signal terminal. The driving transistor is configured to output a current corresponding to a voltage difference between a control electrode and a first electrode to a light emitting device. The compensation circuit is configured to compensate a threshold voltage of the driving transistor based on a threshold voltage of a reference transistor.

6 Claims, 3 Drawing Sheets

PIXEL DRIVING CIRCUIT, RELATED DRIVING METHOD, PIXEL CIRCUIT, AND DISPLAY PANEL

CROSS-REFERENCE TO RELATED APPLICATIONS

This application is the National Stage Entry of PCT/CN2019/094392 filed on Jul. 2, 2019, the entire disclosure of which is incorporated herein by reference as part of the disclosure of this application.

TECHNICAL FIELD

The present invention relates to the field of displaying technology, and particularly to a pixel driving circuit, a driving method thereof, a pixel circuit and a display panel.

BACKGROUND

In the displaying field, Organic Light-Emitting Diode (OLED) display devices have the characteristics of a wide viewing angle and a fast response speed, and thus are used widely. In the OLED display device, a pixel driving circuit uses a current provided by a driving transistor to drive a light emitting device to emit light.

SUMMARY

Embodiments of the present disclosure provide a pixel driving circuit, a pixel circuit, a display panel and a method for driving the pixel driving circuit. A first aspect of the present disclosure provides a pixel driving circuit. The pixel driving circuit includes an input circuit, a reset circuit, a driving transistor and a compensation circuit. The input circuit is coupled to a gate driving signal terminal, an input signal terminal and a first node, and configured to provide, according to a gate driving signal from the gate driving signal terminal, a data signal from the input signal terminal to the first node. The reset circuit is coupled to a reset control signal terminal, a first voltage terminal and a second node, and configured to provide, according to a reset control signal from the reset control signal terminal, a first voltage from the first voltage terminal to the second node. The driving transistor includes a first electrode coupled to a second voltage terminal, a control electrode coupled to the compensation circuit via the first node, and a second electrode coupled to a light emitting device, and is configured to output a current corresponding to a voltage difference between the control electrode and the first electrode of the driving transistor to the light emitting device. The compensation circuit includes a reference transistor, and the compensation circuit is coupled to a third voltage terminal, the second node, the first node, a control signal terminal, and the second voltage terminal, and configured to compensate, based on a threshold voltage of the reference transistor, a threshold voltage of the driving transistor.

In an embodiment of the present disclosure, the compensation circuit may include a first storage circuit, the reference transistor, a second storage circuit and a control circuit. The first storage circuit may be coupled between a third node and the second voltage terminal, and configured to store a first voltage difference between the third node and the second voltage terminal. A control electrode of the reference transistor may be coupled to the third voltage terminal, a first electrode of the reference transistor may be coupled to the first node, and a second electrode of the reference transistor may be coupled to the third node, and the reference transistor may be configured to provide, according to a voltage difference between the control electrode and the first electrode of the reference transistor, a voltage of the first node to the third node. The second storage circuit may be coupled between the second node and the first node, and configured to store a second voltage difference between the second node and the first node. The control circuit may be coupled to the second node, a control signal terminal and the third voltage terminal, and configured to provide, under a control of a control signal from the control signal terminal, the third voltage to the second node.

In an embodiment of the present disclosure, the threshold voltage of the reference transistor may be the same as the threshold voltage of the driving transistor.

In an embodiment of the present disclosure, the reference transistor may be the same as the driving transistor in material, structure, and shape.

In an embodiment of the present disclosure, the first storage circuit may include a first capacitor. A first terminal of the first capacitor may be coupled to the third node, and a second terminal of the first capacitor may be coupled to the second voltage terminal.

In an embodiment of the present disclosure, the second storage circuit may include a second capacitor. A first terminal of the second capacitor may be coupled to the second node, and a second terminal of the second capacitor may be coupled to the first node.

In an embodiment of the present disclosure, the first capacitor may be the same as the second capacitor in capacitance value.

In an embodiment of the present disclosure, the control circuit may include first transistor. A control electrode of the first transistor may be coupled to the control signal terminal, a first electrode of the first transistor may be coupled to the third voltage terminal, and a second electrode of the first transistor may be coupled to the second node.

In an embodiment of the present disclosure, the input circuit may include a second transistor. A control electrode of the second transistor may be coupled to the gate driving signal terminal, a first electrode of the second transistor may be coupled to the input signal terminal, and a second electrode of the second transistor may be coupled to the first node.

In an embodiment of the present disclosure, the reset circuit may include a third transistor. A control electrode of the third transistor may be coupled to the reset control signal terminal, a first electrode of the third transistor may be coupled to the first voltage terminal, and a second electrode of the third transistor may be coupled to the second node.

In an embodiment of the present disclosure, the first storage circuit may include a first capacitor. A first terminal of the first capacitor may be coupled to the third node, and a second terminal of the first capacitor may be coupled to the second voltage terminal. The second storage circuit may include a second capacitor. A first terminal of the second capacitor may be coupled to the second node, and a second terminal of the second capacitor may be coupled to the first node. The first capacitor may be the same as the second capacitor in capacitance value. The control circuit may include a first transistor. A control electrode of the first transistor may be coupled to the control signal terminal, a first electrode of the first transistor may be coupled to the third voltage terminal, and a second electrode of the first transistor may be coupled to the second node. The input circuit may include a second transistor. A control electrode of the second transistor may be coupled to the gate driving signal terminal, a first electrode of the second transistor may be coupled to the input signal terminal, and a second electrode of the second transistor may be coupled to the first node. The reset circuit may include a third transistor. A control electrode of the third transistor may be coupled to the reset control signal terminal, a first electrode of the third transistor may be coupled to the first voltage terminal, and a second electrode of the third transistor may be coupled to the second node.

A second aspect of the present disclosure provides a display panel. The display panel includes a pixel circuit. The pixel circuit comprises the pixel driving circuit according to the first aspect of the present disclosure, and a light emitting device coupled to the pixel driving circuit.

A third aspect of the present disclosure provides a method for driving the pixel driving circuit according to the first aspect of the present disclosure. The method include in a reset stage, providing, according to a reset control signal, a first voltage to a second node, in a data input stage, providing, according to a gate drive signal, a data signal to the first node, and storing a first voltage difference between a second voltage terminal and the first node, and a second voltage difference between the first node and the second node, and in a compensation output stage, providing, according to a control signal, a third voltage to the second node, so as to compensate, based on a threshold voltage of the reference transistor, the voltage of the first node to compensate a threshold voltage of the driving transistor, and causing the driving transistor to provide, based on the compensated voltage of the first node and a second voltage, an output current to an light emitting device.

In an embodiment of the present disclosure, the pixel driving circuit may be a pixel driving circuit according to the first aspect, the compensation output stage may include a compensation stage and an output stage, and the threshold voltage of the reference transistor may be the same as the threshold voltage of the driving transistor. The method may include in the reset stage, turning on, according to the reset control signal, the third transistor to provide the first voltage to the second node to reset the voltage of the first node, in the data input stage, turning on, according to the gate driving signal, the second transistor to provide the data signal to the first node, and storing, by a first capacitor, the first voltage difference, and storing, by a second capacitor, the second voltage difference, in the compensation stage, turning on, according to the control signal, the first transistor to provide the third voltage to the second node, wherein in response to a voltage change of the second node, the reference transistor may be firstly turned on, the first capacitor may be connected in parallel with the second capacitor and the voltage of the first node may be compensated to V3−Vth, then the reference transistor may be turned off, and the second capacitor may continue to compensate the voltage of the first node to 2Vdata−V1+Vth, wherein V3 may represent the third voltage, V1 may represent the first voltage, Vth may represent the threshold voltage, and Vdata may represent the data signal, and in the output stage, providing, based on the compensated voltage 2Vdata−V1+Vth of the first node and the second voltage, the output current to the light emitting device by the driving transistor.

BRIEF DESCRIPTION OF THE DRAWINGS

In order to illustrate technical solutions of the present disclosure more clearly, drawings of embodiments will be briefly described below. It could be appreciated that the drawings described below merely relate to some embodiments of the present disclosure, rather than limiting the present disclosure. In the drawings.

DETAILED DESCRIPTION

Figure 1:
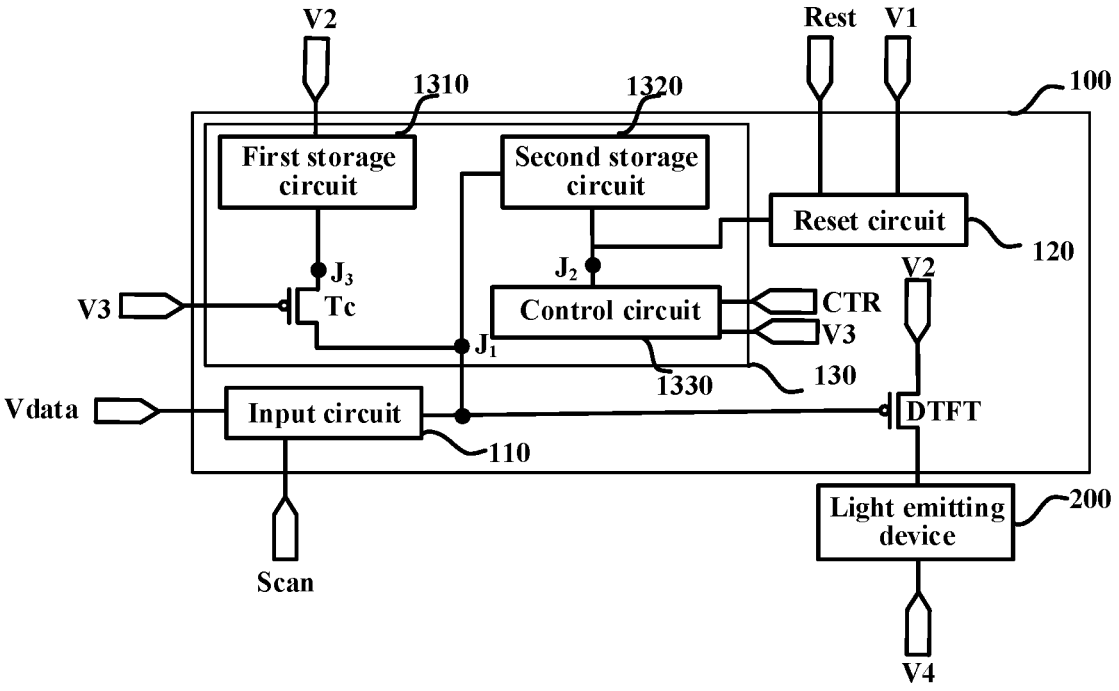
FIG. 1 shows a schematic block diagram of a pixel driving circuit according to an embodiment of the present disclosure.

In order to make technical solutions and advantages of the embodiments of the present disclosure more clear, the technical solutions of the embodiments of the present disclosure will be clearly and completely described below in conjunction with the drawings. Obviously, the embodiments described merely some but not all of embodiments of the present disclosure. Based on the described embodiments of the present disclosure, all other embodiments obtained by those skilled in the art without creative work also fall within the protecting scope of the present disclosure.

Unless otherwise defined, the technical terms or scientific terms used in the present disclosure should have the same meaning as commonly understood by those skilled in the art to which the matter of the present disclosure belongs. The words such as "first", "second" and the like used in the present disclosure do not denote any order, quantity, or importance, but rather are used to distinguish different components. Similarly, the terms "a(an)", "one" etc., are not intended to limit the amount, but indicate the presence of at least one element. The terms "comprise", "comprising", "include", "including", "contain", "containing" etc. are intended that an element or article ahead of this term encompasses element(s) (or equivalent(s)) or article(s) (or equivalent(s)) listed behind this term, and does not exclude the other elements or articles. The phrases "connected", "coupled" etc., are not intended to define a physical connection or mechanical connection, but may include an electrical connection, a direct connection or an indirect connection via intermediate media.

In the OLED display device, the pixel driving circuit controls the current provided to the light emitting device by controlling a voltage of a control electrode of the driving transistor DTFT, thereby controlling a brightness of the light emitting device. Specifically, a first electrode of the driving transistor DTFT is coupled to a voltage terminal with a constant voltage. The driving transistor outputs the current from the second electrode based on a voltage difference VGS between the voltage of the control electrode and the constant voltage. This current is used to drive the light emitting device to emit light. The current I output from the second electrode of the driving transistor may be determined by Formula (1):

$$I=K(VGS-Vth)2, \qquad \text{Formula (1)}$$

where K represents a coefficient, and Vth represents a threshold voltage of the driving transistor.

Therefore, it can be seen from Formula (1) that the current I outputted from the second electrode is related to the threshold voltage Vth of the driving transistor DTFT. Therefore, in the pixel driving circuit in the related art, the difference in threshold voltage of driving transistor DTFT would directly affect the brightness of the light emitting device, thereby affecting brightness uniformity of the entire display device. Therefore, in order to meet a requirement in the uniformity for emitting light by the display panel, it is necessary to improve consistency in electrical characteristics, such as the threshold voltage, of the driving transistor. In prior art, internal compensation or external compensation may be used to improve the consistency in electrical characteristics of the driving transistor.

In the conventional internal compensation method, the DTFT needs to be powered on in advance to sense the threshold voltage of the DTFT, and then the threshold voltage of the DTFT can be effectively compensated based on the sensed threshold voltage. However, this method would increase operation time except that of conventional display of the DTFT disadvantageously, thereby degrading the DTFT in performance, and reducing lifetime of the display device.

In view of the accuracy problem above, an embodiment of the present disclosure provides the pixel driving circuit which can not only perform threshold voltage compensation on the voltage of the control electrode of the driving transistor to solve the problem of brightness uniformity caused by the difference in the threshold voltage of the driving transistor, but also avoid increasing the operation time of the driving transistor unnecessarily.

Embodiments of the present disclosure provide the pixel driving circuit, the driving method for driving the pixel driving circuit, the pixel circuit and the display panel. The embodiments and examples of the present disclosure will be described in detail below in conjunction with the drawings.

FIG. 1 shows a schematic block diagram of the pixel driving circuit according to an embodiment of the present disclosure. As shown in FIG. 1, the pixel driving circuit 100 may include an input circuit 110, a reset circuit 120, a driving transistor DTFT, and a compensation circuit 130. The pixel driving circuit 100 will be described in detail with reference to the drawing.

The input circuit 110 may be coupled to a gate driving signal terminal, an input signal terminal and a first node J1. The input circuit 110 may receive a gate driving signal Scan from the gate driving signal terminal and a data signal Vdata from the input signal terminal. Furthermore, the input circuit 110 may provide the data signal Vdata to the first node J1 according to the gate driving signal Scan.

The reset circuit 120 may be coupled to a reset control signal terminal, a first voltage terminal and a second node J2. The reset circuit 120 may receive a reset control signal Rest from the reset control signal terminal and a first voltage V1 from the first voltage terminal. Furthermore, the reset circuit 120 may provide the first voltage V1 to the second node J2 according to the reset control signal Rest, so as to reset the first node J1.

The control electrode of the driving transistor DTFT and the compensation circuit 130 may be coupled to the first node J1, so that the control electrode of the driving transistor DTFT may be coupled to the compensation circuit 130 via the first node J1. A first electrode of the driving transistor DTFT may be coupled to the second voltage terminal, and a second electrode of the driving transistor DTFT may be coupled to the light emitting device 200. The driving transistor DTFT outputs a current signal corresponding to a voltage difference between the control electrode and the first electrode. In the embodiment, the light emitting device may be the OLED.

The compensation circuit 130 may include a reference transistor Tc, and may be coupled to a third voltage terminal, the second node J2, the first node J1, a control signal terminal, and the second voltage terminal. The compensation circuit 130 may receive a third voltage V3 from the third voltage terminal, a control signal CTR from the control signal terminal, and a second voltage V2 from the second voltage terminal, and it may compensate, based on a threshold voltage of the reference transistor Tc, the threshold voltage Vth of the driving transistor DTFT according to the control signal CTR, the third voltage V3, and the second voltage V2. In the embodiment of the present disclosure, the reference transistor Tc and the driving transistor DTFT have the same threshold voltage, i.e., Vth. Further, the reference transistor Tc and the driving transistor DTFT may have the same material, structure, and shape. It could be understood that in actual production process, due to the limitation of the manufacturing process, there may be a certain difference between the threshold voltage of the reference transistor Tc and the threshold voltage of the driving transistor DTFT. In the embodiment of the present disclosure, the third voltage V3 is smaller than the first voltage V1.

Further, the compensation circuit 130 may comprise a first storage circuit 1310, the reference transistor Tc, a second storage circuit 1320, and a control circuit 1330. Specifically, the first storage circuit 1310 may be coupled between the third node J3 and the second voltage terminal, and may store a first voltage difference between the third node J3 and the second voltage terminal. A control electrode of the reference transistor Tc may be coupled to the third voltage terminal, a first electrode of the reference transistor Tc may be coupled to the first node J1, and a second electrode of the reference transistor Tc may be coupled to the third node J3, and a voltage of the first node J1 may be provided to the third node J3 according to a voltage difference between the third voltage V3 and the voltage of the first node J1. The second storage circuit 1320 may be coupled between the second node J2 and the first node J1, and may store a second voltage difference between the second node J2 and the first node J1. The control circuit 1330 may be coupled to the second node J2, the control signal terminal, and the third voltage terminal. The control circuit 1330 may receive the control signal CTR from the control signal terminal and the third voltage V3 from the third voltage terminal, and provide the third voltage V3 to the second node J2 according to the control signal CTR.

Figure 2:
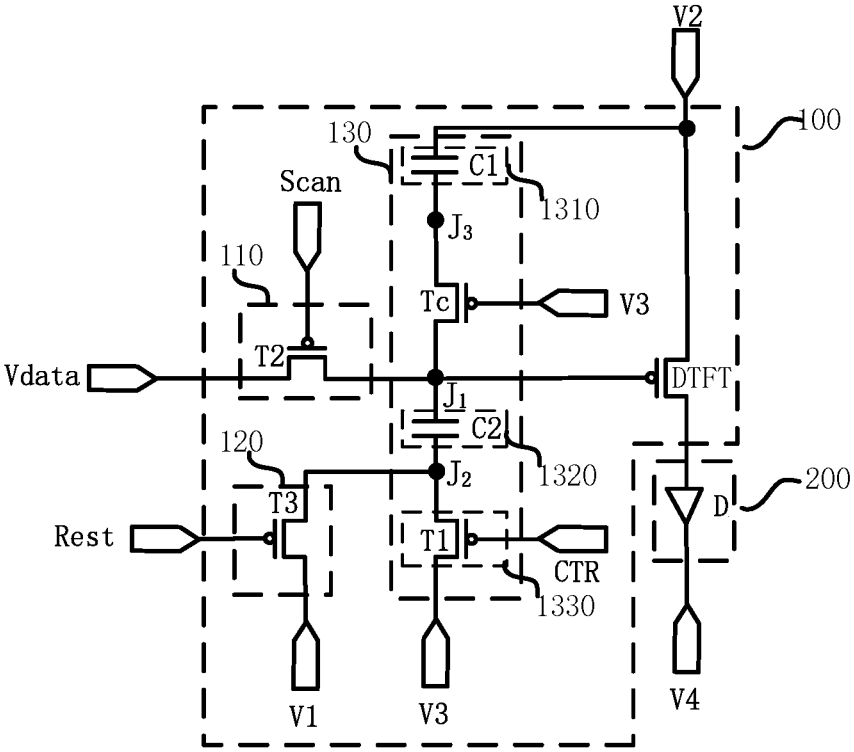
FIG. 2 shows an exemplary circuit diagram of the pixel driving circuit according to an embodiment of the present disclosure.

The pixel driving circuit provided by the embodiment of the present disclosure will be described below in conjunction with an exemplary circuit structure. FIG. 2 shows an exemplary circuit diagram of the pixel driving circuit according to an embodiment of the present disclosure. As shown in FIG. 2, the pixel driving circuit 100 may include the reference transistor Tc, a first transistor T1 to a third transistor T3, a first capacitor C1 and a second capacitor C2, and the driving transistor DTFT.

The first transistor T1 to the third transistor T3 may be all switching transistors.

It should be noted that all the transistors used in the embodiments of the present disclosure may be thin film transistors or other active devices with the same or similar characteristics. In the embodiments of the present disclosure, all the transistors are thin film transistors. A source electrode and a drain electrode of the transistor used here may be symmetrical in structure, so the source electrode and the drain electrode may be no difference in structure. In the embodiments of the present disclosure, a gate electrode of the transistor may be referred to as the control electrode, and the two electrodes other than the gate electrode may be referred to as the first electrode and the second electrode, respectively. For ease of understanding, all the transistors are P-type enhancement transistors in the embodiments of the present disclosure. Those skilled in the art could understand that other types of transistors are also possible.

As shown in FIG. 2, the first storage circuit 1310 may include the first capacitor C1. The second storage circuit 1320 may include the second capacitor C2. The control circuit 1330 may include the first transistor T1. The first storage circuit 1310, the second storage circuit 1320, and the control circuit 1330 in the compensation circuit 130 will be described below in detail with reference to the drawing.

A first terminal of the first capacitor C1 may be coupled to the third node J3, and a second terminal may be coupled to the second voltage terminal, so as to store the voltage difference between the third node J3 and the second voltage terminal.

A first terminal of the second capacitor C2 may be coupled to the second node J2, and the second terminal may be coupled to the first node J1, so as to store the voltage difference between the second node J2 and the first node J1. In the embodiment, a capacitance value C1 of the first capacitor C1 and a capacitance value C2 of the second capacitor C2 may be the same. In the embodiment, when the voltage of the second node J2 changes and the first node J1 is not in a floating state, due to the characteristic that a voltage at each of the two electrodes of the capacitor cannot change suddenly, the two electrodes of the second capacitor C2 may have the same charge change amount. When the voltage of the second node J2 changes and the first node J1 is in the floating state, since the voltage difference stored in the second capacitor C2 keeps constant (i.e., the equipotential jumping effect of the capacitor), the first node J1 and the voltage of the second node J2 may have the same charge change amount.

A control electrode of the first transistor T1 may be coupled to the control signal terminal to receive the control signal CTR. A first electrode of the first transistor T1 may be coupled to the second node J2. A second electrode of the first transistor T1 may be coupled to the third voltage terminal to receive the third voltage V3. In the embodiment, when the control signal CTR is at a low level, the first transistor T1 is turned on, and the received third voltage V3 can be provided to the second node J2.

As shown in FIG. 2, the input circuit 110 may include the second transistor T2. A control electrode of the second transistor T2 may be coupled to the gate driving signal terminal to receive the gate driving signal Scan. A first electrode of the second transistor T2 may be coupled to the input signal terminal to receive the data signal Vdata. A second electrode of the second transistor T2 may be coupled to the first node J1. When the gate driving signal Scan is at a low level, the second transistor T2 is turned on, and the data signal Vdata can be provided to the first node J1. In the embodiment, the data signal Vdata cannot enable the driving transistor DTFT, that is to say, a voltage difference between the data signal Vdata and the second voltage V2 is greater than the threshold voltage Vth. Therefore, the data signal Vdata should satisfy: Vdata>V2+Vth.

As shown in FIG. 2, the reset circuit 120 may include the third transistor T3. A control electrode of the third transistor T3 may be coupled to the reset control signal terminal to receive the reset control signal Rest. A first electrode of the third transistor T3 may be coupled to the first voltage terminal to receive the first voltage V1. A second electrode of the third transistor T3 may be coupled to the second node J2. When the reset control signal Rest is at a low level, the third transistor T3 is turned on, and the first voltage V1 can be provided to the second node J2.

In the embodiment shown in FIG. 2, the reference transistor Tc, the first transistor T1 to the third transistor T3, and the driving transistor DTFT may be P-type transistors. It's known by those skilled in the art that the reference transistor Tc, the first transistor T1 to the third transistor T3, and the driving transistor DTFT may also be N-type transistors.

The operating process of the pixel driving circuit 100 as shown in FIG. 2 will be described below in conjunction with the signal timing diagram in FIG. 3.

Figure 3:
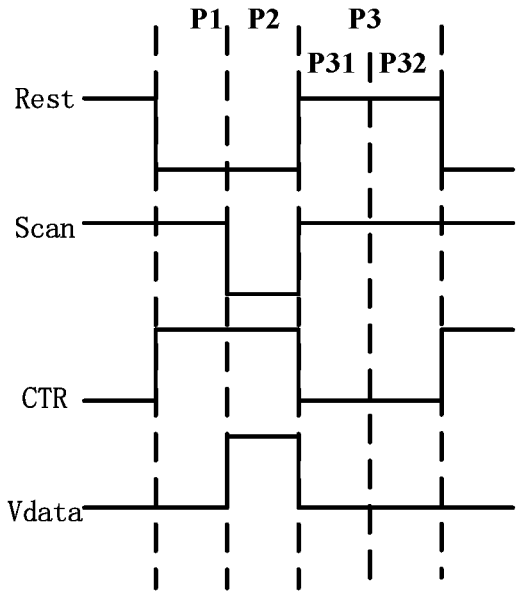
FIG. 3 shows a timing diagram of signals during an operating process of the pixel driving circuit as shown in FIG. 2.

FIG. 3 shows a timing diagram of signals during the operating process of the pixel driving circuit 100 as shown in FIG. 2. It could be understood that the signal voltages in the timing diagram of signals as shown in FIG. 3 are only schematic and do not represent the actual voltage values.

As shown in FIG. 3, in a reset stage P1, when the reset control signal terminal provides the reset control signal Rest at a low level, the third transistor T3 is turned on. The received first voltage V1 may be provided to the second node J2, thus the voltage of the first node J1 is reset to VJ10. In the embodiment of the present disclosure, the voltage difference between VJ10 and the second voltage V2 should be greater than the threshold voltage Vth of the driving transistor DTFT, so as to turn off the driving transistor DTFT. The reset process will be described in detail below in conjunction with a compensation output stage before the reset stage.

In a data input stage P2, when the gate driving signal terminal may provide a gate driving signal Scan at a low level, the second transistor T2 is turned on. The received data voltage Vdata may be provided to the first node J1. In addition, under a control of the third voltage V3, the reference transistor Tc is turned on, that is to say, the voltage difference between the third voltage V3 and the first node J1 is less than or equal to the threshold voltage Vth. Therefore, the data signal Vdata should satisfy: Vdata≥V3−Vth. The first capacitor C1 may store a first voltage difference between the second voltage V2 and the first node J1, i.e., V2−Vdata. The second capacitor C2 may store the second voltage difference between the first node J1 and the second node J2, i.e., Vdata−V3.

The compensation output stage P3 may include a compensation stage P31 and an output stage P32. In the compensation stage P31, when the control signal terminal provides control signal CRT at a low level, the first transistor T1 is turned on, and the received third voltage V3 may be provided to the second node J2. The voltage of the second node J2 may change from the first voltage V1 to the third voltage V3. When the voltage difference between the third voltage V3 and the voltage of the first node J1 received by the control electrode of the reference transistor Tc is less than or equal to the threshold voltage Vth, the reference transistor Tc is turned on. As for the first node J1, the first capacitor C1 and the second capacitor C2 may be connected in parallel. In response to the voltage of the second node J2 changing from the first voltage V1 to the third voltage V3, the first electrode and the second electrode of the second capacitor C2 may have the same change amount. As described above, in the embodiment, the first voltage V1 is greater than the third voltage V3, so the voltage of the first node J1 may decrease. Then, the voltage difference between the third voltage V3 and the voltage of the first node J1 received by the gate electrode of the reference transistor Tc may become greater than the threshold voltage Vth, so that the reference transistor Tc may be turned off. Based on the equipotential jumping effect of the second capacitor C2, the second node J2 and the first node J1 may have the same voltage change amount. The voltage of the first node J1 changes to VJ11 as soon as the reference transistor Tc is switched from on to off, VJ11 can be calculated by the following Formula (2):

$$VJ_{11}=V_3-V_{th}, \quad \text{Formula (2)}$$

Assuming that the voltage change amount at the second node J2 is ΔV1 during turn-on of the reference transistor Tc, the charge change amount ΔQ1 at the first electrode of the second capacitor C2 coupled to the second node J2 can be calculated by the following Formula (3):

$$\Delta Q_1=\Delta V1*C_2, \quad \text{Formula (3)}$$

As described above, as for the first node J1, the first capacitor C1 and the second capacitor C2 are connected in parallel. Therefore, the charge change amount ΔQ2 at the second electrode of the second capacitor C2 coupled to the first node J1 can be calculated by the following Formula (4):

$$\Delta Q_2=(C_1+C_2)*(VJ_{11}-\text{Vdata}), \quad \text{Formula (4)}$$

The charge change amount ΔQ1 at the first electrode of the second capacitor C2 should be equal to the charge change amount ΔQ2 at the second terminal of the second capacitor C2. Therefore, through Formula (3) and Formula (4), it can be obtained that the voltage change amount ΔV1 at the second node J2 during the turn-on to turn-off of the reference transistor Tc is:

ΔV1=(C1+C2)/C2*(VJ11−Vdata). In the embodiment, the first capacitor C1 and the second capacitor C2 may have the same capacitance value, then $$\Delta V1=2(VJ_{11}-\text{Vdata}), \quad \text{Formula (5)}$$

Then, the reference transistor Tc is turned off. Assuming that after the reference transistor Tc is turned off, the voltage change amount at the second node J2 is ΔV2, and the stable voltage of the first node J1 is VJ12. After the reference transistor Tc is turned off, the first node J1 is in the floating state, based on the equipotential jumping effect of the second capacitor C2, the voltage change amount at the first node J1 is equal to the voltage change amount ΔV2 at the second node J2, that is, $$\Delta V2=VJ_{12}-VJ_{11}, \quad \text{Formula (6)}$$

Therefore, the total voltage change amount $V_3$-$V_1$ at the second node J2 should satisfy the following relations:

$$\begin{aligned} V3-V1 &= \Delta V1+\Delta V2 \quad \text{Formula (7)} \\ &= 2(VJ_{11}-Vdata)+VJ_{12}-VJ_{11} \\ &= VJ_{11}-2Vdata+VJ_{12}, \end{aligned}$$

in conjunction with the Formula (2), it may be obtained:

$$VJ_{12}=2\text{Vdata}-V_1+V_{th}, \quad \text{Formula (8)}$$

In the output stage P32, the voltage VJ12=2Vdata−$V_1$+Vth may be provided to the control electrode of the driving transistor DTFT. Based on the voltage VJ12 and the second voltage V2, the driving transistor DTFT may provide an output current I to the light emitting device, it thus should be satisfied that 2Vdata−V1+Vth−V2≤Vth, and thus the data signal Vdata should satisfy Vdata≤½(V1+V2). Based on the voltage VJ12 and the third voltage V3, the reference transistor Tc is turned off, it thus should be satisfied that V3−(2Vdata−$V_1$+Vth)>Vth, and thus the data signal Vdata should satisfy Vdata<½(V1+V3)−Vth. In this case, the current I outputted from the second electrode of the driving transistor DTFT may be calculated according to Formula (1), as shown in Formula (9):

$$\begin{aligned} I &= K(V_{GS}-V_{th})^2 \quad \text{Formula (9)} \\ &= K[((2Vdata-V1+V_{th})-V2-V_{th}]^2 \\ &= K(2Vdata-V1-V2)^2, \end{aligned}$$

where, K represents a coefficient.

According to Formula (9), it can be concluded that the current I outputted from the second electrode of the driving transistor DTFT is independent of the threshold voltage Vth thereof. Therefore, the brightness of the light emitting device is independent of the threshold voltage Vth, and furthermore the brightness uniformity of the display panel is not affected by the threshold voltage Vth of the driving transistor DTFT. In addition, the compensation process does not increase the number of times the driving transistor DTFT is turned on or the operation time except that of the normal display. Therefore, the compensation process would not reduce the lifetime of the display device.

Then, to prepare for the input of the next data signal, the reset stage starts. This process is the verse of the compensation process in the compensation stage. Specifically, in the reset stage, when the reset control signal terminal provides the reset control signal Rest at a low level, the third transistor T3 is turned on. The received first voltage V1 may be provided to the second node J2. The voltage of the second node J2 may change from the third voltage V3 to the first voltage V1. When the voltage difference between the third voltage V3 received by the control electrode of the reference transistor Tc and the voltage of the first node J1 is greater than the threshold voltage Vth, the reference transistor Tc is turned off. Due to the equipotential jumping effect of the second capacitor C2, the voltage change amount at the first node J1 is the same as the voltage change amount of the second node J2. As described above, in the embodiment, the first voltage V1 is greater than the third voltage V3, so the voltage of the first node J1 rises. Then, the voltage difference between the received third voltage V3 and the voltage of the first node J1 becomes equal to or less than the threshold voltage Vth, so that the reference transistor Tc is turned on. For the first node J1, the first capacitor C1 and the second capacitor C2 are connected in parallel. The two electrodes of the second capacitor C2 may have the same charge change amount, so the voltage of the first node J1 continues rising. This process is the inverse of the process in the compensation stage P31, and the reset voltage of the first node J1 may be calculated as the data voltage Vdata, i.e., VJ10=Vdata, which will be omitted.

Figure 4:
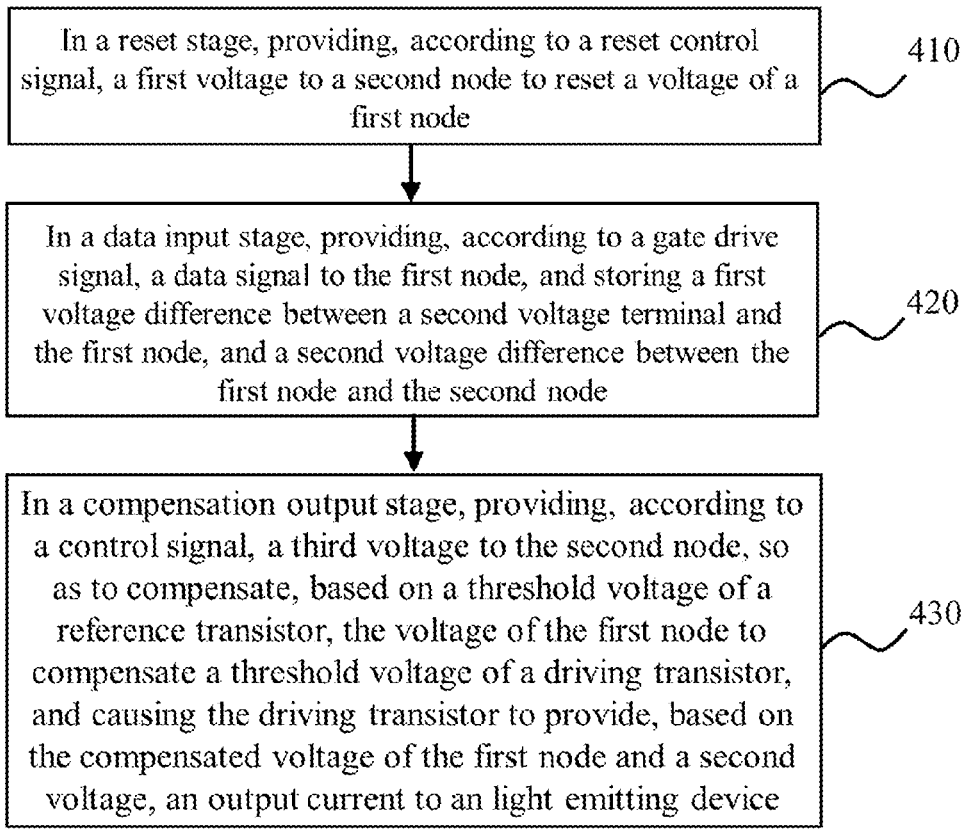
FIG. 4 shows a schematic flowchart of a method for driving the pixel driving circuit according to an embodiment of the present disclosure.

In addition, the embodiments of the present disclosure also provide a method for driving the pixel driving circuit. FIG. 4 shows a schematic flowchart of the method for the pixel driving circuit according to an embodiment of the present disclosure. The pixel driving circuit may be any applicable pixel driving circuit based on the embodiments of the present disclosure.

At step 410, in the reset stage P1, according to the reset control signal Rest, the first voltage V1 may be provided to the second node J2. In the embodiment, the reset circuit 120 may provide the received first voltage V1 to the second node J2 according to the reset control signal Rest, and then reset the first node J1. Further, according to the reset control signal Rest, the third transistor T3 is turned on and provides the first voltage V1 to the second node J2 to reset the voltage of the first node J1.

At step 420, in the data input stage P2, according to the gate driving signal Scan, the data signal Vdata may be provided to the first node J1, and the first voltage difference between the second voltage terminal and the first node J1, and the second voltage difference between the first node J1 and the second node J2 may be stored. In the embodiment, the input circuit 110 may provide the data signal Vdata to the first node J1 according to the gate drive signal Scan at a low level. Further, according to the gate driving signal Scan, the second transistor T2 is turned on and provides the data signal Vdata to the first node J1. Then, since the voltage difference between the third voltage V3 received by the control electrode of the reference transistor Tc in the compensation circuit 130 and the first node J1 is smaller than the threshold, the voltage of the first node J1 may be provided to the third node J3. The first storage circuit 1310 in the compensation circuit 130 may store the first voltage difference between the second voltage terminal and the first node J1. Further, the first capacitor C1 may store the first voltage difference. The second storage circuit 1330 in the compensation circuit 130 may store the second voltage difference between the first node J1 and the second node J2. Further, the second capacitor C2 may store the second voltage difference.

At step 430, in the compensation output stage P3, according to the control signal CRT, the third voltage $V_3$ may be provided to the second node J2 to compensate, based on the threshold voltage Vth of the reference transistor Tc, the threshold voltage Vth of the driving transistor DTFT, so that the output current I may be provided to the light emitting device 200 by the driving transistor DTFT according to the compensated voltage VJ12 of the first node and second voltage V2. In the compensation stage P31, according to the control signal CRT, the first transistor T1 is turned on and provides the third voltage V3 to the second node J2. The compensation circuit 130 may compensate the threshold voltage Vth of the driving transistor DTFT in response to the first voltage V1 changing to the third voltage V3 at the second node J2. As described above, in the embodiment, the first voltage V1 is greater than the third voltage V3. The threshold voltage Vth of the driving transistor DTFT may be compensated through the following steps in sequence. First, the reference transistor Tc is turned on. Therefore, in view of the first node J1, the first capacitor C1 and the second capacitor C2 are connected in parallel. Based on that the voltages at each of the two electrode of the second capacitor C2 cannot change suddenly, the second electrode and the first electrode of the second capacitor C2 have the same charge change amount. As described above, in the embodiment, the first voltage V1 is greater than the third voltage V3, so the voltage of the first node J1 decreases until the first transistor T1 is turned off. As described above, the voltage of node J1 is V3−Vth, then, the reference transistor Tc becomes turn-off, and the voltage of the first node J1 continues decreasing based on the equipotential jumping effect of the second capacitor C2. According to Formula (8), it can be concluded that the voltage of the first node J1 is compensated as VJ12=2Vdata−V1+Vth. In the output stage P32, the driving transistor DTFT may provide the output current I to the light emitting device according to the voltage VJ12 and the second voltage V2. The output current I can be calculated according to Formula (9). This current I is independent of the threshold voltage Vth of the driving transistor DTFT. Therefore, the brightness of the light emitting device is independent of the threshold voltage Vth, and thus the brightness uniformity of the display panel is not affected by the threshold voltage Vth of the driving transistor.

Those skilled in the art will appreciate that the above steps are described in an order, which is not intended to limit on the order in which the method is performed, and the embodiments of the present disclosure may also be implemented in any other suitable order.

Figure 5:
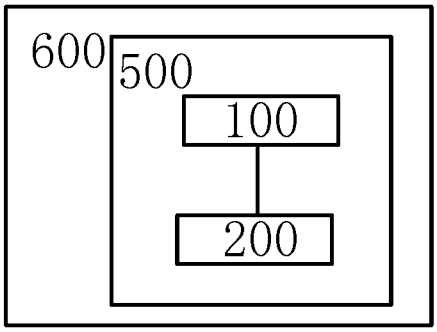
FIG. 5 shows a schematic block diagram of a display panel according to an embodiment of the present disclosure.

In addition, an embodiment of the present disclosure also provides a display panel. FIG. 5 shows a schematic block diagram of the display panel 600 according to an embodiment of the present disclosure. As shown in FIG. 5, the display panel 600 may include a pixel circuit 500. The pixel circuit 500 may include the pixel driving circuit 100 according to the embodiments of the present disclosure and the light emitting device 200 coupled to the pixel driving circuit 100. The display panel 600 provided by the embodiments of the present invention may be used in any display device. The display device may be any product or component with a display function such as a liquid crystal panel, an LCD TV, a display, an OLED panel, an OLED TV, an electronic paper display device, a mobile phone, a tablet computer, a laptop computer, a digital photo frame, a navigator, and the like. embodiments of the present disclosure have been described in detail above, but the protection scope of the present disclosure is not limited thereto. Obviously, various modifications, substitutions, or variations in form of the embodiments of the present disclosure may be made by those of ordinary skilled in the art without departing from the spirit and scope of the present disclosure. The protection scope of the present disclosure is defined by the appended claims.

What is claimed is:

1. A pixel driving circuit, comprising: an input circuit, a reset circuit, a driving transistor and a compensation circuit, wherein the input circuit is coupled to a gate driving signal terminal, an input signal terminal and a first node, and configured to provide, according to a gate driving signal from the gate driving signal terminal, a data signal from the input signal terminal to the first node;

wherein the reset circuit is coupled to a reset control signal terminal, a first voltage terminal and a second node, and configured to provide, according to a reset control signal from the reset control signal terminal, a first voltage from the first voltage terminal to the second node;

wherein the driving transistor comprises a first electrode coupled to a second voltage terminal, a control electrode coupled to the compensation circuit via the first node, and a second electrode coupled to a light emitting device, and is configured to output a current corresponding to a voltage difference between the control electrode and the first electrode of the driving transistor to the light emitting device;

wherein the compensation circuit comprises a reference transistor, and the compensation circuit is coupled to a third voltage terminal, the second node, the first node, a control signal terminal, and the second voltage terminal, and configured to compensate, based on a threshold voltage of the reference transistor, a threshold voltage of the driving transistor;

wherein the compensation circuit comprising a first storage circuit, the reference transistor, a second storage circuit and a control circuit, wherein the first storage circuit is coupled between a third node and the second voltage terminal, and configured to store a first voltage difference between the third node and the second voltage terminal, wherein a control electrode of the reference transistor is coupled to the third voltage terminal, a first electrode of the reference transistor is coupled to the first node, and a second electrode of the reference transistor is coupled to the third node, and the reference transistor is configured to provide, according to a voltage difference between the control electrode and the first electrode of the reference transistor, a voltage of the first node to the third node, wherein the second storage circuit is coupled between the second node and the first node, and configured to store a second voltage difference between the second node and the first node, and wherein the control circuit is coupled to the second node, the control signal terminal and the third voltage terminal, and configured to provide, under a control of a control signal from the control signal terminal, a third voltage to the second node, wherein the first storage circuit comprises a first capacitor, wherein a first terminal of the first capacitor is coupled to the third node, and a second terminal of the first capacitor is coupled to the second voltage terminal, wherein the second storage circuit comprises a second capacitor, wherein a first terminal of the second capacitor is coupled to the second node, and a second terminal of the second capacitor is coupled to the first node, wherein the first capacitor is the same as the second capacitor in capacitance value, wherein the control circuit comprises a first transistor, wherein a control electrode of the first transistor is coupled to the control signal terminal, a first electrode of the first transistor is coupled to the third voltage terminal, and a second electrode of the first transistor is coupled to the second node, wherein the input circuit comprises a second transistor, wherein a control electrode of the second transistor is coupled to the gate driving signal terminal, a first electrode of the second transistor is coupled to the input signal terminal, and a second electrode of the second transistor is coupled to the first node, and wherein the reset circuit comprises a third transistor, wherein a control electrode of the third transistor is coupled to the reset control signal terminal, a first electrode of the third transistor is coupled to the first voltage terminal, and a second electrode of the third transistor is coupled to the second node, and the threshold voltage of the reference transistor is the same as the threshold voltage of the driving transistor, wherein compensating the threshold voltage of the driving transistor comprises:

in a reset stage, turning on, according to the reset control signal, the third transistor to provide the first voltage to the second node to reset the voltage of the first node;

in a data input stage, turning on, according to the gate driving signal, the second transistor to provide the data signal to the first node, and storing, by the first capacitor, the first voltage difference, and storing, by the second capacitor, the second voltage difference; and in a compensation output stage, wherein the compensation output stage comprises a compensation stage and an output stage, comprising:

in the compensation stage, turning on, according to the control signal, the first transistor to provide the third voltage to the second node, wherein in response to a voltage change of the second node, the reference transistor is firstly turned on, the first capacitor is connected in parallel with the second capacitor and the voltage of the first node is compensated to V3-Vth, then the reference transistor is turned off, and the second capacitor continues to compensate the voltage of the first node to 2Vdata-V1+Vth, wherein V3 represents the third voltage, V1 represents a first voltage, Vth represents the threshold voltage, and Vdata represents the data signal; and in the output stage, providing, based on the compensated voltage 2Vdata-V1+Vth of the first node and the second voltage, an output current to an light emitting device by the driving transistor.

2. The pixel driving circuit according to claim 1, wherein the reference transistor is same as the driving transistor in material, structure, and shape.

3. A display panel comprising a pixel circuit, wherein the pixel circuit comprises:

a pixel driving circuit according to claim 1; and a light emitting device coupled to the pixel driving circuit.

4. A method for driving a pixel driving circuit according to claim 1, the method comprising:

in the reset stage, providing, according to the reset control signal, the first voltage to a second node to reset the voltage of the first node;

in the data input stage, providing, according to the gate drive signal, the data signal to the first node, and storing the first voltage difference and the second voltage difference; and in the compensation output stage, providing, according to the control signal, the third voltage to the second node, so as to compensate, based on the threshold voltage of the reference transistor, the voltage of the first node to compensate the threshold voltage of the driving transistor, and causing the driving transistor to provide, based on the compensated voltage of the first node and the second voltage, the output current to the light emitting device.

5. The method for driving a pixel driving circuit according to claim 4, the method comprising:

in the reset stage, turning on, according to the reset control signal, the third transistor to provide the first voltage to the second node to reset the voltage of the first node;

in the data input stage, turning on, according to the gate driving signal, the second transistor to provide the data signal to the first node, and storing, by the first capacitor, the first voltage difference, and storing, by the second capacitor, the second voltage difference; and in the compensation output stage:

in the compensation stage, turning on, according to the control signal, the first transistor to provide the third voltage to the second node, wherein in response to the voltage change of the second node, the reference transistor is firstly turned on, the first capacitor is connected in parallel with the second capacitor and the voltage of the first node is compensated to V3-Vth, then the reference transistor is turned off, and the second capacitor continues to compensate the voltage of the first node to 2Vdata-V1+Vth, wherein V3 represents the third voltage, V1 represents the first voltage, Vth represents the threshold voltage, and Vdata represents the data signal; and in the output stage, providing, based on the compensated voltage 2Vdata-V1+Vth of the first node and the second voltage, the output current to the light emitting device by the driving transistor.

6. The method for driving a pixel driving circuit according to claim 5, wherein the reference transistor is the same as the driving transistor in material, structure, and shape.

* * * * *